US006499165B1

(12) United States Patent
Morgillo

(10) Patent No.: US 6,499,165 B1
(45) Date of Patent: Dec. 31, 2002

(54) INFANT SAFETY DEVICE

(76) Inventor: Angelo Morgillo, P.O. Box 624 5th Melb 3205 Vic Aust., Albert Park, Victoria 3206 (AU)

( * ) Notice: Subject to any disclaimer, the term of this patent is extended or adjusted under 35 U.S.C. 154(b) by 0 days.

(21) Appl. No.: 09/763,721

(22) PCT Filed: Aug. 25, 1999

(86) PCT No.: PCT/AU99/00686

§ 371 (c)(1),
(2), (4) Date: May 29, 2001

(87) PCT Pub. No.: WO00/11990

PCT Pub. Date: Mar. 9, 2000

(30) Foreign Application Priority Data

Aug. 25, 1998 (AU) ..... PP5475
Apr. 30, 1999 (AU) ..... 26908/99

(51) Int. Cl.[7] ..... A47G 9/00
(52) U.S. Cl. ..... 5/655; 5/490
(58) Field of Search ..... 5/655, 485, 490, 5/494, 436, 437; 128/872, 869

(56) References Cited

U.S. PATENT DOCUMENTS

| | | | | | |
|---|---|---|---|---|---|
| 3,269,621 A | * | 8/1966 | Dishart | 5/655 |
| 3,323,150 A | | 6/1967 | Rehder | |
| 4,862,535 A | * | 9/1989 | Roberts | 5/655 |
| 5,165,130 A | | 11/1992 | Wendling | 5/655 |
| 5,233,714 A | | 8/1993 | De Bell Daniel | 5/655 |
| 5,439,008 A | | 8/1995 | Bowman | 5/655 |
| 5,826,287 A | | 10/1998 | Tandrup | 5/655 |
| 6,009,874 A | * | 1/2000 | Sartin et al. | 5/655 |

FOREIGN PATENT DOCUMENTS

| | | | |
|---|---|---|---|
| AU | 1859292 | 6/1992 | |
| AU | 719438 | 12/1997 | |
| FR | 2379268 | * 10/1978 | |
| GB | 2268679 | 1/1994 | |
| NZ | 249608 | 4/1997 | |
| WO | 9314678 | 8/1993 | |
| WO | 9317606 | 9/1993 | 5/494 |
| WO | 9517118 | 6/1995 | |
| WO | 9803369 | 1/1998 | |

* cited by examiner

*Primary Examiner*—Alexander Grosz

(57) ABSTRACT

A safety device (2) for use in safely restraining an infant, particularly on a flat substrate, is described, the safety device (2) comprising a support portion (4) for supporting the body of the infant and a harness portion (20) for restraining the body of the infant in the supported position in which the harness (20) includes a number of flaps (16, 22, 24, 28) which co-operate with each other to envelop a part of the body of the infant, thereby restraining the infant. The device may be in the form of a U-pillow or in the form of a pillowcase for a U-pillow. In addition, the device is provided with a pocket (14) for storing the harness when not in use and for acting as a neck, head or shoulder rest by providing an extra thickness of padding.

30 Claims, 3 Drawing Sheets

INFANT SAFETY DEVICE

BACKGROUND OF THE INVENTION

The present invention generally relates to safety devices for humans and methods of using the device to keep humans safe, particularly young children, infants, toddlers or the like. More particularly, the present invention relates to safety devices for use with infants and to methods of using the device to keep infants safe when placed on a substrate, such as for example the floor of a dwelling, a bed, in a pram or similar location, particularly when placed on a flat surface where there is a danger of the infant rolling off or over the substrate. Even more particularly, the present invention relates to a combined support and harness in the form of a pillow, cushion or similar, a pillowcase or other covering for the pillow or cushion, for maintaining infants in a safe and secure position when placed on the substrate, particularly a flat surface over which the infant can roll. The present invention finds particular application as a combined pillow and harness or a pillowcase containing a harness for infants generally under the age of 12 months to prevent the infant from rolling over or becoming wedged or otherwise located underneath the pillow when placed on a substrate, thus providing safety for the infant whilst unattended.

Although the present invention will be described with particular reference to one form of a combined support and safety harness in the form of a pillow, it is to be noted that the scope of the present invention is not restricted to the described embodiment, but rather the scope of the present invention is more extensive so as to include other arrangements of the device and its use in other applications, and to other forms, such as for example including pillowcases for covering U-shaped pillows, in which the pillowcase is provided with a harness for restraining the body or torso of the infant on or in the pillow.

In the description of the present invention, it is to be noted that in the interests of safety for the infant, the infant should not be left unattended, or if left unattended it should be for as short a time as possible. Whilst the device of the present invention is primarily a safety device for infants when left unattended, it is recommended that if the device is used such periods during which the child is unattended be reduced to a minimum Infants, particularly infants under the age of about nine months, often need to be placed on substrates, particularly flat surfaces, such as for example the floor, on the upper surface of a bed, or even in a pram or similar. If the infants are unsupported or unrestrained, there is a chance that through movement, such as for example kicking, they could roll or otherwise move into a position which is more dangerous than the original position in which they were located, such as for example by becoming lodged under a pillow on the bed. It is to be noted that care must be exercised in placing the infant in an appropriate position, such as for example as recommended to reduce the chances of sudden infant death syndrome (SIDS) or similar, when originally placing the infant.

Attempts have been made to prevent the infant from moving, such as for example by placing pillows, bolsters, cushions or the like on either side of the baby to form a barrier, restraint or similar. Such loose and temporary supports are not always effective, in that the infant can roll under the loose support or can move the temporary support out of the way, or move to a position where the support or restraint is no longer effective. This is particularly so of supports which are adjustable or have portions which are adjustable.

One attempt to address the problems associated with such temporary loose supports is the so-called "U-pillow", which is generally a pillow in the shape of a U, having two more or less tapering side arms connected on either side of a rear portion, in which a gap or space is defined between the arms and the rear portion. The infant is placed in this gap or space. Whilst such pillows are referred to as "U-pillows", it is to be noted that the side arms can adopt a range of angles when extending from the rear support portion. In some instances, the U-pillows are referred to as "triangular" pillows. Whilst U-pillows provide support and restrain the infant from sideways movement, owing to the shape and design of the U-pillow the infant often is able to slide off or burrow underneath the m or rear portion of the U-pillow so that the rear support section of the U-pillow can be located over the face and head region of the infant. In this position, there is a chance that the infant will suffocate, or at least become distressed by being in an unfamiliar and threatening position, particularly if the child is left unattended even for short periods of time.

Accordingly, U-pillows or the like suffer from a number of deficiencies. Therefore, there is a need to address these deficiencies by providing a modified U-pillow or pillowcase for covering the U-pillow, to enable the infant to be supported and restrained in the original safe position so that even if the infant is left unattended for periods of time (which is not recommended) there is little or no chance that the infant can move to a more dangerous position.

Accordingly, it is an aim of the present invention to provide an infant safety device which overcomes at least one of the disadvantages of existing similar devices by providing in one form a combined support and harness for restraining the infant and for maintaining the baby or infant in a safe position, or in a second form a harness adapted to co-operate with a support to restrain the infant in a safe position. Thus, the present invention includes within its scope both a modified U-pillow and a pillowcase with harness for the U-pillow or similar.

SUMMARY OF THE INVENTION

According to the present invention there is provided an infant safety device for supporting an infant in a predetermined position, comprising a supporting arrangement or a cover for a supporting arrangement in which the supporting arrangement has at least one support element for providing support for the infant when in the predetermined position, and a harness arrangement comprising at least one harness member for maintaining the infant in the predetermined position in relation to the supporting arrangement during use of the device when the infant is located in the predetermined position, wherein the predetermined position is a substantially safe position and wherein the at least one harness member is connected to or co-operates with the support arrangement or cover for the support arrangement, whereby the combined effect of the support arrangement and the harness arrangement both supports the infant and maintains the infant in the safe position so that when the infant is supported by the support arrangement in the predetermined position, the harness arrangement is operative to maintain the infant in this position.

Typically, the supporting arrangement is a pillow. More typically, the pillow is a generally U-shaped pillow or a triangular pillow. More typically, the U-shaped pillow is provided with two side support arms and a rear support portion in which the arms are connected to the rear portion at either side of the rear portion to define the support arrangement. Even more typically, the two side arms and rear support portion define a generally U-shaped or V-shaped space for receiving the infant.

Preferably, the safety device is a pillowcase designed to cover the U-shaped or V-shaped pillow. More preferably, the pillowcase has two arm portions for covering the respective arms of the U-shaped pillow and a body portion for covering the rear part of the U-shaped pillow.

Typically, in use, the infant is placed in the U-shaped space defined between the two support arms so that the back of the infant is supported by the rear support portion and the side support portion and is constrained from movement away from the support arrangement by the side arms, More typically, the head and back of the infant are supported by the rear support portion and located between the side support portions in the space. Even more typically, the infant is supported in a reclining position in which the head is located at a level above that of the body. Even more typically, the infant can be located on its back or on its front.

Typically, the harness can be integral with the support by being part of the pillow, or part of the pillowcase, or the harness may be separate from the support by being either attached to the pillow or to the pillowcase. Irrespective of the form of the support or of the harness, the harness arrangement is provided with at least one element or member. Typically, the element or member is a flexible element, such as a flap or similar. More typically, the harness comprises two or more flaps. Even more typically, there are three or four flaps which co-operatively interact with each other.

Typically, at least some of the flaps are arranged to at least partially overlap with each other. Even more typically, the ends of at least some of the flaps overlap. Typically, the ends of the flaps are provided with suitable fastening means. Even more typically, the flaps in an operative position form a cross or cruciform shape for enveloping the body or torso of the infant. More typically, the fastening means are releasable fastening means, preferably velcro strips, press studs or similar releasable fasteners.

Typically, the safety device is provided with a pocket into which the harness may be folded when not in use. More typically, the pocket is associated with the rear support portion. Even more typically, the pocket is located on the upper surface in use of the rear support portion spanning between the side support portions. Even more typically, the pocket forms a headrest or additional support area for the infant when supported by the device in use. More typically, one of the flaps forms the pocket.

Typically, two of the flaps are arranged in opposed relationship. More typically, three of the flaps are located regularly spaced apart from each other to extend in different directions. More typically, the flaps are foldable around the infant to form the harness to restrain the body of the infant.

Typically, movement of the infant when in the harness is prevented by the stability of the device in that the side support portions or arms act as outriggers which prevent substantial movement of the infant, and prevent the device from being translocated or from inverting, tipping over or the like.

Typically, the device of the present invention can be provided with suitable filling, such as for example polystyrene beads, stuffing, packaging, wool or the like, or can be provided in an unfilled condition ready for filling. For example, the U-pillow may be provided in a pillow-case like configuration together with instructions for filling with appropriate material or may be a pillowcase adapted to receive a U-pillow or to cover a U-pillow.

Other objects and advantages of the invention will be apparent from the following description, the accompanying drawings and appended claims.

BRIEF DESCRIPTION OF THE DRAWINGS

The present invention will now be described by way of example with reference to the accompanying drawings in which.

DETAILED DESCRIPTION OF THE PREFERRED EMBODIMENT

Figure 1:
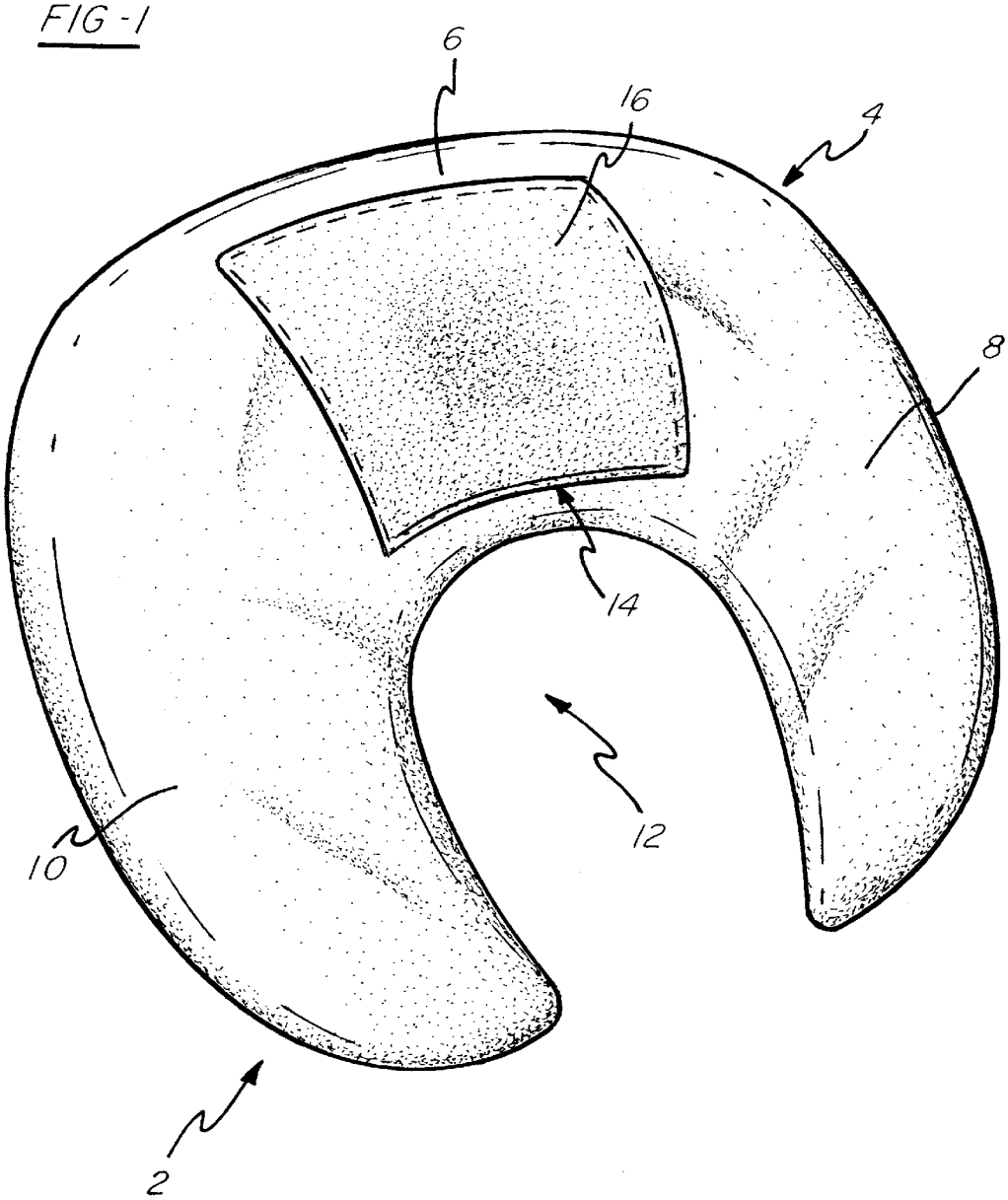
FIG. 1 is a top plan view of one form of the infant safety device of the present invention in which the harness is folded and stored within the pocket located on the top surface of the device.

With particular reference to FIG. 1, there is shown one form of the device of the present invention generally denoted as 2. The support arrangement 4 of the device 2 is a generally U-shaped pillow, a horseshoe shaped cushion or similar. Pillow 4 comprises a generally arcuate rear support portion 6 and two side support portions or arms 8, 10 extending generally perpendicularly from either side of the rear support portion 6 in spaced apart parallel relationship to form side support arm. Rear support portion 6 and side arms 8, 10 provide a support surface for the infant (as shown more particularly in FIG. 3) by defining a generally U-shaped support surface in the form of a gap 12 which is of a corresponding U-shape or horseshoe shape. In use, the infant is placed substantially in gap 12 and is partially maintained in place by the support surface formed from the rear support and the side support arms.

A pocket 14 is provided in the top surface of rear support portion 6 extending between both side arms 8 and 10. A support harness 20 when in a folded configuration is located within pocket 14 when the harness is not in use. In this configuration, as shown in FIG. 1, the device acts as a conventional U-pillow without the harness. Flap 16 which is used to form pocket 14 also acts as an additional support area for the infant by acting as a head rest or neck or shoulder rest. Additionally, the extra thicknesses of the flaps of the harness and flap 16 provide additional padding for supporting the head, neck and shoulders of the infant.

Figure 2:
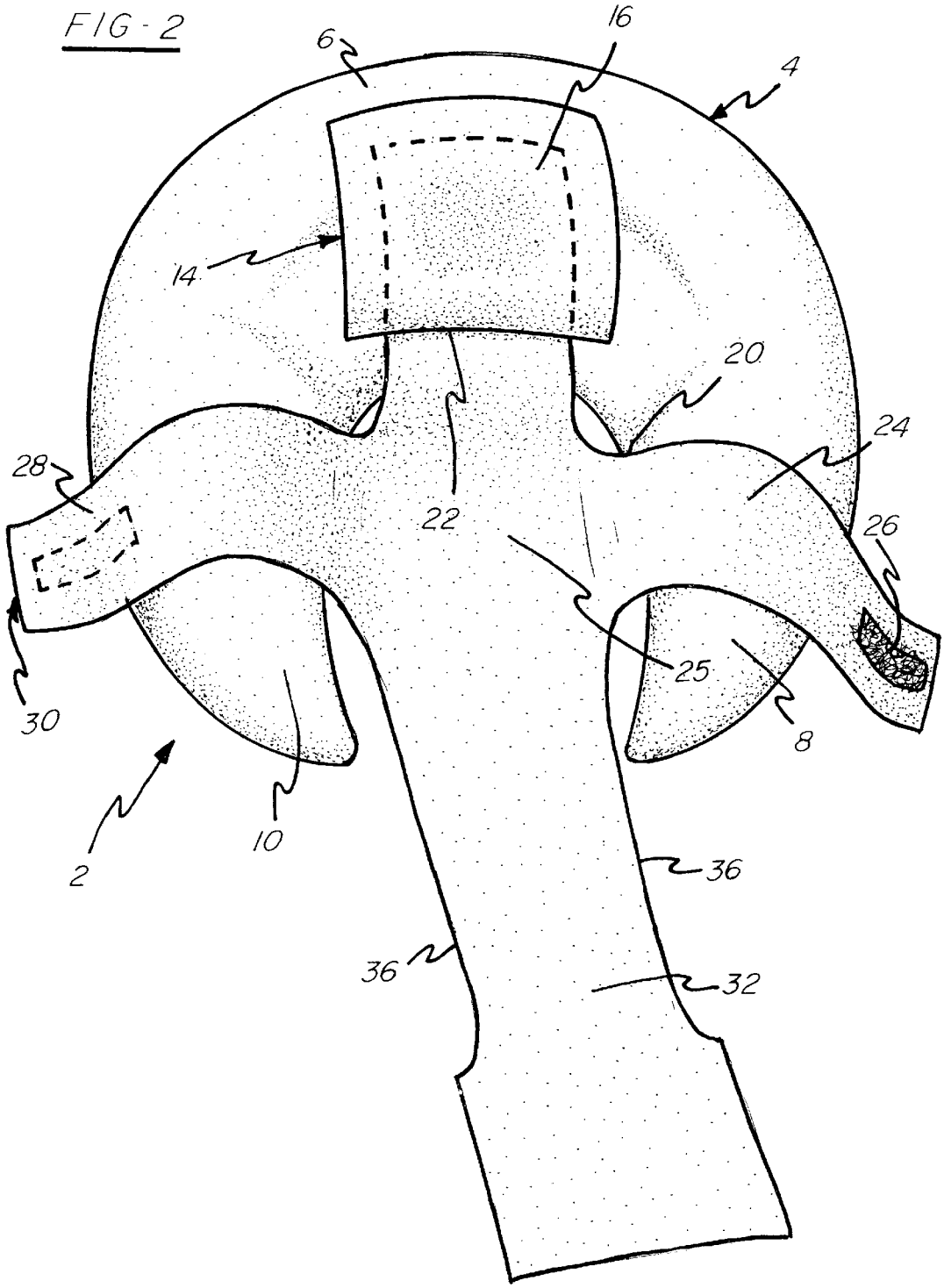
FIG. 2 is a top perspective view of the device of FIG. 1 in which the harness is in an extended position in readiness for receiving the body of the infant.

With particular reference to FIG. 2 which shows the harness in an unfolded configuration ready for use, support harness 20 will now be described in more detail. Support harness 20 comprises a number of individual flaps or foldable portions and a connecting portion. Connecting portion 22 is located beneath pocket flap 16 and is sewn or otherwise secured to the upper surface of rear support portion 6, such as by sewing or other suitable fastening means. Connecting portion 22 securely connects the harness 20 to pillow 4. A first side flap 24 extends from the main body portion 25 of support harness 20 to one side so as to overlie one side support arm 8. A velcro strip or other suitable fastener 26 is provided at or towards the distal end of flap 24 on one surface. A second side flap 28 extends from the opposite side of the main body portion 25 of harness 20 to overlie the other side support arm 10, and is also provided with a velcro strip 30 or similar on one surface. It is to be noted that the velcro strip 26 is located on a different surface to the velcro strip 30 so that when the two side flaps 24, 28 overlap each other the respective velcro strips co-operatively engage with each other to hold the respective flaps in place. Body flap 32 extends longitudinally from the body portion 25 of support harness 20 between the two wide flaps 24, 28. Body flap 32 is shaped to conform to the lower portion of the body of the infant by being provided with shaped intermediate portions 36 of a generally arcuate shape.

Figure 3:
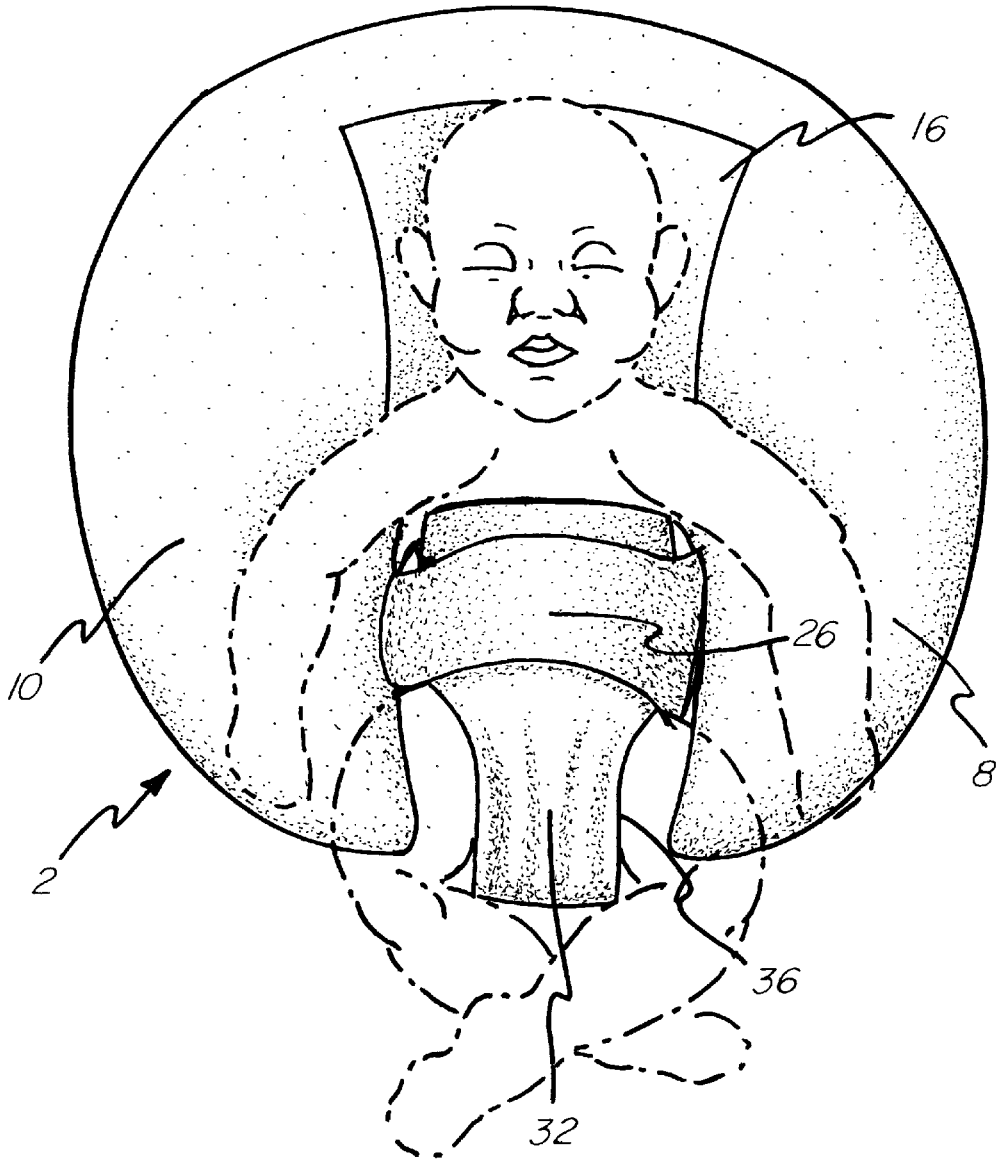
FIG. 3 is a top perspective view of the device of FIGS. 1 and 2 in which the infant is received in the harness in use in which the flaps are secured over the body of the infant.

Body portion 32 is optionally provided with a velcro strip or other suitable fastening means allowing both side flaps 24, 28 and body flap 32 to be securely connected to each other as is shown more particularly in FIG. 3. Alternatively, the distal end of body flap 32 is retained in place between the lower body of the infant and the overlapping distal ends of side flaps 24, 28.

Another form of the present invention (not illustrated) involves the use of flap 16 and connecting portion 22 being the same component in which flap 16 forms the pocket and also the connecting piece so that the remaining parts of the harness can be folded into the pocket formed by flap 16. In this embodiment, there is no separate connecting portion 22.

In use of the device 2 of the present invention, device 2 is placed on a suitable substrate such as the floor, bed or similar. The harness arrangement 20 is folded out of pocket 14 and placed in a position similar to that shown in FIG. 2 with the flaps extended in readiness for receiving the infant. The infant is placed on the device 2 so that the head of the infant contacts the outer surface of pocket 14 which provides additional support for the head of the infant. The body portion of the infant is placed on the body of the harness arrangement, typically in the vicinity of central portion 25, and nestles within gap 12 of the device. Body flap 32 and body side flaps 24, 28 are folded about the lower trunk of the infant and securely fastened by the velcro fastening strips 26, 30. In this position, the infant is located in a predetermined position between the side support arms 8, 10 and the rear support portion 6 and is retained in this position by the flaps of the harness. Therefore, the infant is both located and maintained in a safe and secure position with little or no possibility of moving the device 2 or tipping it over, even if the infant should attempt to move the device 2 by kicking or similar movement.

Another form of the device is a pillowcase for covering a U-pillow. The pillowcase and harness arrangement are provided as an integral unit, including the provision of the pocket. With this embodiment, the U-pillow is received in the pillowcase so that a combined support and harness arrangement is provided. In this pillowcase form of the invention, the harness is directly connected to the pillowcase rather than to the pillow as described previously. The harness may take any form that is suitable.

Advantages of the present invention include the following:

The U-pillow and/or U-pillowcase may be used as a conventional U-pillow or may be used as a combined safety device providing support and restraint.

When the infant is located within the harness, it is prevented from movement, particularly movement burrowing underneath the device, thereby preventing the infant from suffocating or being distressed.

The side support arms, as well as providing support for the head, neck, shoulders and back of the infant, also act as outriggers preventing the device from being tipped over or otherwise overturned from its normal orientation.

The device of the present invention may be used to support the infant in other situations, such as for example by placing the pillow on a person's lap and supporting the infant in the device, so that the infant is additionally supported in such circumstances which can include when the infant is being fed, particularly breast-fed.

The device of the present invention may be used to support an infant when the infant is attempting to sit up, to prevent the infant from falling to one side. Also, it may be used to maintain the infant in a reclining position or a substantially reclining position.

The described arrangement has been adduced by explanation and many modifications may be made without departing from the spirit and scope of the invention which includes every novel feature and novel combination of features hereindisclosed.

Those skilled in the art will appreciate that the invention described herein is susceptible to variations and modifications other than those specifically described. It is understood that the invention includes all such variations and modifications which fall within the spirit and scope.

What is claimed is:

1. An infant safety device (2) comprising:

a generally U-shaped pillow (4) having a gap (12) extending therethrough for safely supporting the infant in a generally reclining position, said gap (12) being defined by first and second side support arms (8, 10) and a rear support portion (6) wherein the first and second arms (8, 10) are connected to the rear support portion (6) on opposing sides thereof, said rear support portion (6) extending away from a plane of a flat substrate, said rear support portion (6) and the first and second side arms (8, 10) cooperating to assist in supporting the infant in the generally reclining position on the flat substrate; and a harness arrangement (20) comprising at least one harness member (16, 24, 28, 32) for restraining the infant in the gap (12), at least a part of the harness arrangement (20) cooperating with the generally U-shaped pillow (4) to prevent separation of the harness arrangement (20) therefrom, said at least one harness member (16, 24, 28, 32) of the harness arrangement (20) cooperating with the infant to restrain the infant in the gap (12) whereby the pillow (4) and the harness arrangement (20) combine to safely support and restrain the infant in the generally reclining position.

2. The infant safety device as recited in claim 1 further including a pillow cover for cooperatively receiving said pillow (4), said at least a part of the harness arrangement (20) cooperating with the pillow cover to prevent separation of the harness arrangement (20) therefrom.

3. The infant safety device as recited in claim 1 wherein said at least one member (16, 24, 28, 32) includes two flaps (24, 28) provided with releasable fastening means (26, 30) located substantially adjacent a distal end thereof for permitting cooperative engagement of said two flaps (26, 30) such that said two flaps (26, 30) partially envelop a torso of the infant to restrain the infant in the reclining position.

4. The infant safety device as recited in claim 1 wherein said at least one member (16, 24, 28, 32) includes a flap (24) provided with releasable fastening means (26) located substantially adjacent a distal end thereof for permitting cooperative engagement of said flap (24) with the pillow (4) to at least partially envelop a torso of the infant to restrain the infant in the reclining position.

5. The infant safety device as recited in claim 1 wherein the pillow (4) is provided with a pocket (14) for receiving the harness arrangement (20), said pocket (14) being provided on the rear support portion (6) of the pillow (4).

6. The infant safety device as recited in claim 5 wherein the pocket (14) is attached to the pillow (4) around at least a part of a perimeter of the pocket (14) such that a portion of the perimeter is open to allow access into the pocket (14).

7. The infant safety device as recited in claim 6 wherein the pocket (14) further forms a support area for a head, neck or shoulders of the infant when the infant is supported by the device (2) in the reclining position.

8. The infant safety device as recited in claim 1 wherein the generally U-shaped pillow (4) is generally U-shaped along a central plane of the device (2).

9. The infant safety device as recited in claim 8 wherein the infant is supported in the reclining position by the rear support portion (6) and further is prevented from rolling sideways by the first and second side arms (8,10).

10. The infant safety device as recited in claim 1 wherein the first and second side support arms (8, 10) extend outwardly from the rear support portion (6) in spaced apart parallel relationship to each other.

11. The infant safety device as recited in claim 1 wherein the harness arrangement (20) is undetachably connected to the pillow (4).

12. The infant safety device as recited in claim 1 wherein the at least one harness member (16,24, 28, 32) is flexible.

13. The infant safety device as recited in claim 1 wherein said at least one member (16, 24, 28, 32) includes three flaps (24, 28, 32) for at least partially overlapping therewith so that at least one of said three flaps (24, 28, 32) overlies a torso or a body of the infant.

14. The infant safety device as recited in claim 13 wherein said three flaps (24, 28, 32) are provided with releasable fastening means (26, 30).

15. An infant safety device comprising:

a generally U-shaped pillow (4) having a gap (12) extending therethrough for safely supporting the infant in a generally reclining position, said gap (12) being defined by first and second side support arms (8, 10) and a rear support portion (6) wherein the first and second arms (8, 10) are connected to the rear support portion (6) on opposing sides thereof, said rear support portion (6) extending away from a plane of a flat substrate, said rear support portion (6) and the first and second side arms (8, 10) cooperating to assist in supporting the infant in the generally reclining position on the flat substrate;

a pillow cover covering said pillow (4); and a harness arrangement (20) comprising at least one harness member (16, 24, 28, 32) for restraining the infant in the gap (12), at least a part of the harness arrangement (20) cooperating with the pillow cover to prevent separation of the harness arrangement (20) therefrom, said at least one harness member (16, 24, 28, 32) of the harness arrangement (20) cooperating with the infant to restrain the infant in the gap (12) whereby the pillow (4) and the harness arrangement (20) combine to safely support and restrain the infant in the generally reclining position.

16. The infant safety device as recited in claim 15 wherein said at least one member (16, 24, 28, 32) includes two flaps (24, 28) provided with releasable fastening means (26, 30) located substantially adjacent a distal end thereof for permitting cooperative engagement of said two flaps (26, 30) such that said two flaps (26, 30) partially envelop a torso of the infant to restrain the infant in the reclining position.

17. The infant safety device as recited in claim 15 wherein said at least one member (16, 24, 28, 32) includes a flap (24) provided with releasable fastening means (26) located substantially adjacent a distal end thereof for permitting cooperative engagement of said flap (24) with the pillow cover to at least partially envelop a torso of the infant to restrain the infant in the reclining position.

18. The infant safety device as recited in claim 15 wherein said at least one member (16, 24, 28, 32) includes three flaps (24, 28, 32) for enveloping a torso of the infant such that one of said three flaps (24, 28, 32) is locatable between legs of the infant to assist in preventing sliding movement of the infant when restrained in the reclining position.

19. The infant safety device as recited in claim 15 wherein the pillow cover is provided with a pocket (14) for receiving the harness arrangement (20), said pocket (14) being provided on an area of said pillow cover corresponding with the rear support portion (6) of the pillow (4).

20. The infant safety device as recited in claim 19 wherein the pocket (14) is attached to the pillow cover around at least a part of a perimeter of the pocket (14) such that a portion of the perimeter is open to allow access into the pocket (14).

21. The infant safety device as recited in claim 15 wherein the generally U-shaped pillow (4) and pillow cover are generally U-shaped along a central plane of the device (2).

22. The infant safety device as recited in claim 15 wherein the harness arrangement (20) is undetachably connected to the pillow cover.

23. The infant safety device as recited in claim 15 wherein the pillow cover is generally U-shaped.

24. An infant safety device comprising:

a pillow cover for cooperating with a generally U-shaped pillow having a gap for safely supporting the infant in a generally reclining position on a flat substrate; and a harness arrangement (20) comprising at least one harness member (16, 24, 28, 32) for restraining the infant, at least a part of the harness arrangement (20) cooperating with the pillow cover to prevent separation of the harness arrangement (20) therefrom, said pillow cover further including a pocket (14) for receiving the harness arrangement (20), said at least one harness member (16, 24, 28, 32) of the harness arrangement (20) cooperating with the infant for restraining thereof whereby the pillow cover and the harness arrangement (20) combine to safely support and restrain the infant in the generally reclining position.

25. The infant safety device as recited in claim 24 wherein the pillow cover is generally U-shaped.

26. The infant safety device as recited in claim 24 wherein said at least one member (16, 24, 28, 32) includes two flaps (24, 28) provided with releasable fastening means (26, 30) located substantially adjacent a distal end thereof for permitting cooperative engagement of said two flaps (26, 30) such that said two flaps (26, 30) partially envelop a torso of the infant to restrain the infant in the reclining position.

27. The infant safety device as recited in claim 24 wherein said at least one member (16, 24, 28, 32) includes a flap (24) provided with releasable fastening means (26) located substantially adjacent a distal end thereof for permitting cooperative engagement of said flap (24) with the pillow cover to at least partially envelop a torso of the infant to restrain the infant in the reclining position.

28. The infant safety device as recited in claim 24 wherein said at least one member (16, 24, 23, 32) includes three flaps (24,28, 32) for enveloping a torso of the infant such that one of said three flaps (24, 28, 32) is locatable between legs of the infant to assist in preventing sliding movement of the infant when restrained in the reclining position.

29. The infant safety device as recited in claim 24 wherein the pocket (14) is attached to the pillow cover around at least a part of a perimeter of the pocket (14) such that a portion of the perimeter is open to allow access into the pocket (14).

30. The infant safety device as recited in claim 24 wherein the harness arrangement (20) is undetachably connected to the pillow cover.

* * * * *

UNITED STATES PATENT AND TRADEMARK OFFICE

CERTIFICATE OF CORRECTION

PATENT NO. : 6,499,165 B1
DATED : December 31, 2002
INVENTOR(S) : Angelo Morgillo It is certified that error appears in the above-identified patent and that said Letters Patent is hereby corrected as shown below:

Column 2,
Line 14, “the m or rear” should be -- the arms or rear --;

Signed and Sealed this

Twenty-third Day of March, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,499,165 B1
DATED : December 31, 2002
INVENTOR(S) : Angelo Morgillo It is certified that error appears in the above-identified patent and that said Letters Patent is hereby corrected as shown below:

Column 8,
Line 54, "16, 24, 23, 32)" should be -- (16, 24, 28, 32) --.

Signed and Sealed this

Seventh Day of September, 2004

JON W. DUDAS
*Director of the United States Patent and Trademark Office*